US005800591A

United States Patent [19]

Vallomy

[11] Patent Number: 5,800,591

[45] Date of Patent: Sep. 1, 1998

[54] METHOD AND APPARATUS FOR FEEDING A STEELMAKING FURNACE

[75] Inventor: John A. Vallomy, Charlotte, N.C.

[73] Assignee: Techint Compagnia Tecnica Internazionale, Milan, Italy

[21] Appl. No.: 717,413

[22] Filed: Sep. 20, 1996

[51] Int. Cl.[6] ..... F27D 13/00

[52] U.S. Cl. ..... 75/10.63; 75/10.66; 266/901; 373/79; 373/80

[58] Field of Search ..... 75/10.63, 10.66, 75/10.46; 266/216, 901, 44; 373/79, 80, 81

[56] References Cited

U.S. PATENT DOCUMENTS

| | | | |
|---|---|---|---|
| 3,307,935 | 3/1967 | Lindholm | 266/901 |
| 4,543,124 | 9/1985 | Vallomy | 373/79 |
| 4,579,524 | 4/1986 | Kraus | 266/901 |
| 4,609,400 | 9/1986 | Vallomy | 75/10.66 |
| 4,681,537 | 7/1987 | Vallomy | 373/79 |
| 5,400,358 | 3/1995 | Vallomy | 75/10.63 |

*Primary Examiner*—Scott Kastler
*Attorney, Agent, or Firm*—Dougherty & Dremann

[57] ABSTRACT

A heat processing furnace is provided with a bifurcated feeder which allows scrap steel to be introduced to the furnace from an associated preheater, and direct reduced iron, slag formers, carburizers, and other alloys to be introduced through a lower channel in the connecting car pan directly into the furnace. The feeder is arcuate which prevents collection of molten metal and slag splash and spatter in the corners. The feeder is mounted on a connecting car, which is preferably removable and interchangeable. Apparatus for accomplishing connecting car interchangeability is also disclosed.

12 Claims, 5 Drawing Sheets

METHOD AND APPARATUS FOR FEEDING A STEELMAKING FURNACE

FIELD OF THE INVENTION

This invention relates to heat processing furnaces and means for feeding charge materials through door openings in such furnaces. More particularly, the invention is an apparatus for providing a secondary feed means into a furnace for feed materials which do not require substantial preheating, while simultaneously feeding preheated charge materials into the furnace, preventing emissions from escaping the interior of the furnace, and for maintaining the heat level within the furnace. The invention is especially useful in metal refining furnaces, such as steelmaking furnaces, particularly electric arc steelmaking furnaces.

BACKGROUND TO THE INVENTION

Historically, the operation of an electric arc steelmaking furnace has been an intermittent operation, wherein the sequence followed is: charging of steel scrap and/or direct reduced iron, pig iron, slag formers and alloying elements; ignition or establishment of an electric arc between the electrodes in the furnace to create melting conditions for melting the charge and forming a molten metal bath covered by a molten slag; refining for a period of time during which the molten metal portion of the bath is refined to form steel having a desired composition and quality; and periodically raising the electrodes to remove them from contact with the bath and interference with the tapping procedure; and then tapping the molten metal. In addition, slag can be removed by a deslagging, or slag-off, operation as required.

Non-metallics from metal-containing charge materials often cause environmental problems, particularly when burned at low temperatures, which results in incomplete combustion. Under such conditions, the electric arc steelmaking furnace produces noxious emissions, including dioxins. These dioxins form in the furnace or in dust collection ducts from combustion of plastics from pipes and cars, synthetic fibers, paints, cutting oils from turnings, and the like. Dioxins form at temperatures between about 300° and 520° C., with the most favorable temperature for forming such compounds being about 420° to 470° C. Dioxins generally form in the presence of chlorine. The reaction is catalyzed by the presence of copper or other catalyst. In general, the temperature required for dioxin creation is from about 320° to 520° C. Dioxins form readily when combustion takes place at low temperatures. The use of chlorinated compounds in iron and steel processes and recycled scrap material contaminated with cutting oils and plastics containing chlorine, such as PVC, provides all the factors required for the formation of the chlorinated aromatic compounds polychlorinated dibenzo dioxins (PCDD) and polychlorinated dibenzo furans (PCDF).

Such harmful compounds are not produced during continuous scrap preheating and feeding in the present process, because the organic matter in the scrap charge is combusted at high temperatures before it reaches the furnace, and the atmosphere within the preheater is carefully controlled. The presence of CaO and MgO contribute to decrease the possibility of dioxin formation by the chlorine. The incineration chamber following the preheater provides sufficiently high temperature, sufficient turbulence, and an excess of oxygen which results in dioxins and precursors being destroyed. If the destruction of dioxins at this stage is complete, formation later on in the system is avoided by quick cooling of the flue gas through the window of temperature of dioxin formation.

Preheating scrap is essential to the efficient operation of the electric arc furnace. However, applications exist where it is desired to use both scrap and direct reduced iron in form of pellets, lump or other forms of iron as feed material in the production of steel. These other sources of iron do not have combustible matter that can cause dioxin emission problems, nor are there other contaminants which cause atmospheric pollution. Preheating these iron feed sources and other feed materials such as slag formers or alloying elements to the same degree as the scrap is not always necessary to the same degree.

SUMMARY OF THE INVENTION

The invented method introduces steel scrap and direct reduced iron into a heat processing furnace at one point in the preheater where the conditions when conditions are the more appropriate to avoid Fe re-oxidation yet preheating approximately the material.

The invented apparatus is drawn to a bifurcated feeder which has a flat bottom pan for the introduction of scrap fitted within an arcuate lower section which provides a tight seal of the connection furnace-feeding system as well as a discreet port for direct reduced iron in pellet or lump form, slag formers, and alloying elements and other reagents. A preheater is in direct communication with the flat bottomed pan, allowing scrap iron to be processed long enough in the preheater to remove dioxin precursors and other pollutants given off by the scrap. A source of direct reduced iron can be in direct communication with the arcuate lower feed section allowing this source of iron to be omitted from the long term scrap preheating.

The bifurcated feeder is mounted on a moveable charging car, preferably, an interchangeable car, whereby a damaged or inoperable car can be removed from the operating position and replaced with a standby car to reduce operating downtime.

OBJECTS OF THE INVENTION

It is the principal object of the subject invention to provide a method for eliminating or greatly reducing the need for ramming out slag from the corners beneath a feed pan in the scrap feed entry to an electric arc steelmaking furnace.

It is also an object of this invention to provide a bifurcated feeding device for a furnace which gives great flexibility to the steelmaking process.

It is a further object of the intention to provide an improved method of feeding direct reduced iron (DRI) along with scrap iron and steel to a steelmaking furnace, either cold or hot, directly from the direct reduction unit.

It is also an object of this invention to provide an improved method of minimizing melting furnace problems due to molten metal splash or spatter.

It is also an object of this invention to provide improved operation and maintenance of a feeding apparatus by using an interchangeable connecting car.

BRIEF DESCRIPTION OF THE DRAWINGS

The foregoing and other objects will become more readily apparent by referring to the following detailed description and the appended drawings, in which.

DETAILED DESCRIPTION

Figure 1:
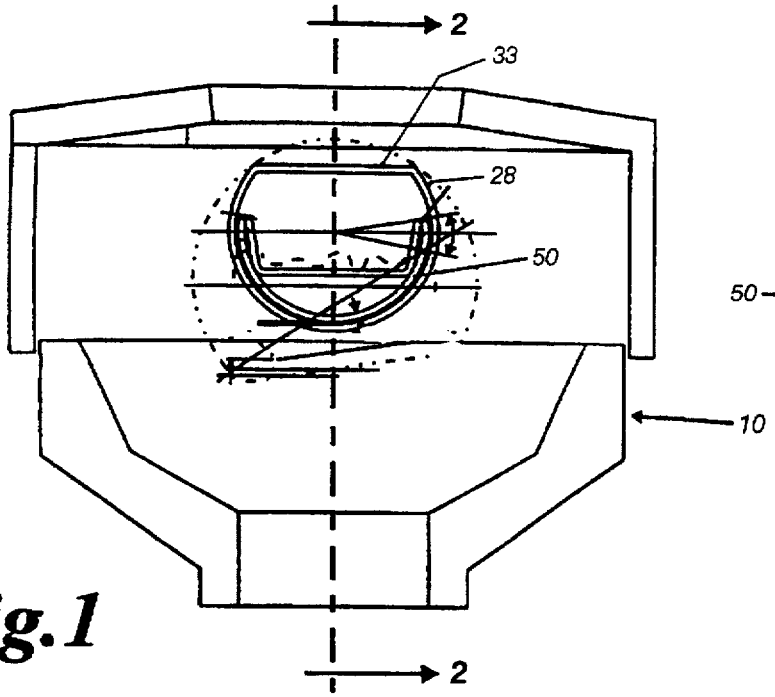
FIG. 1 is a frontal cross-sectional view of the invented connecting car pan or feeder and associated furnace with the feeder inserted into the furnace through an opening in the furnace sidewall.
Figure 7:
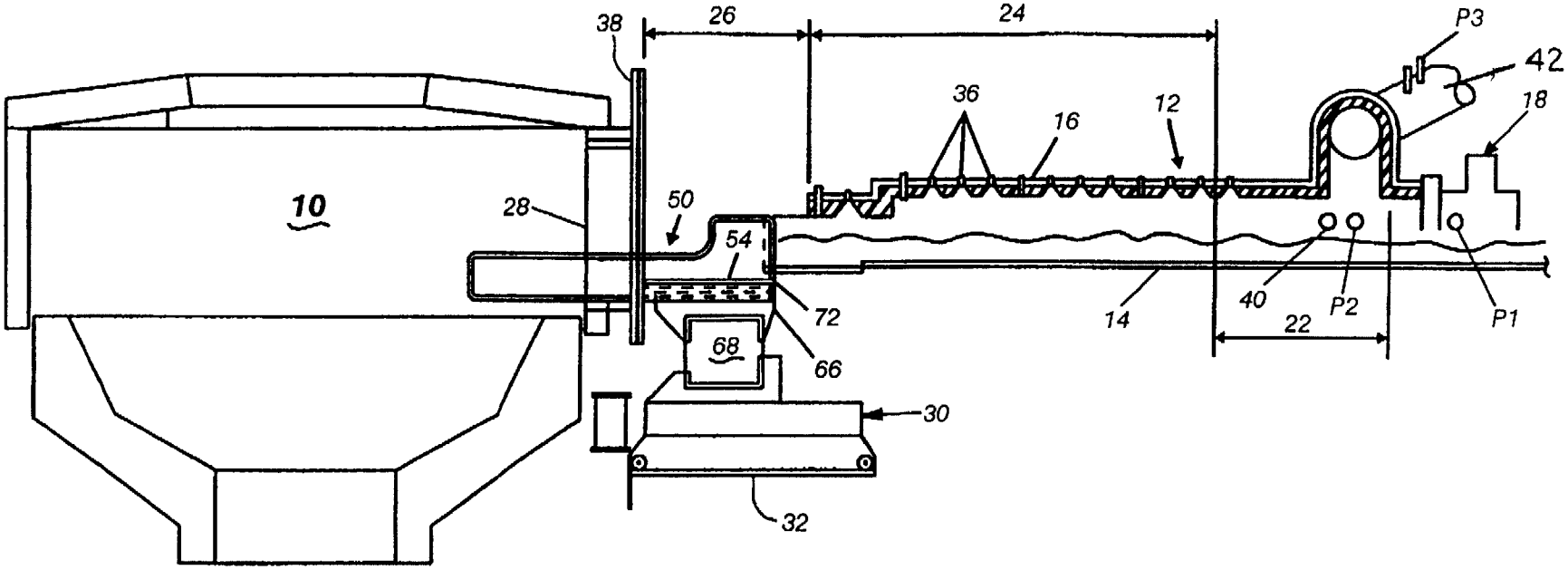
FIG. 7 is a horizontal cross-section view taken of an electric furnace and the invented connecting car pan of FIG. 1 showing an associated scrap preheater.
Figure 9:
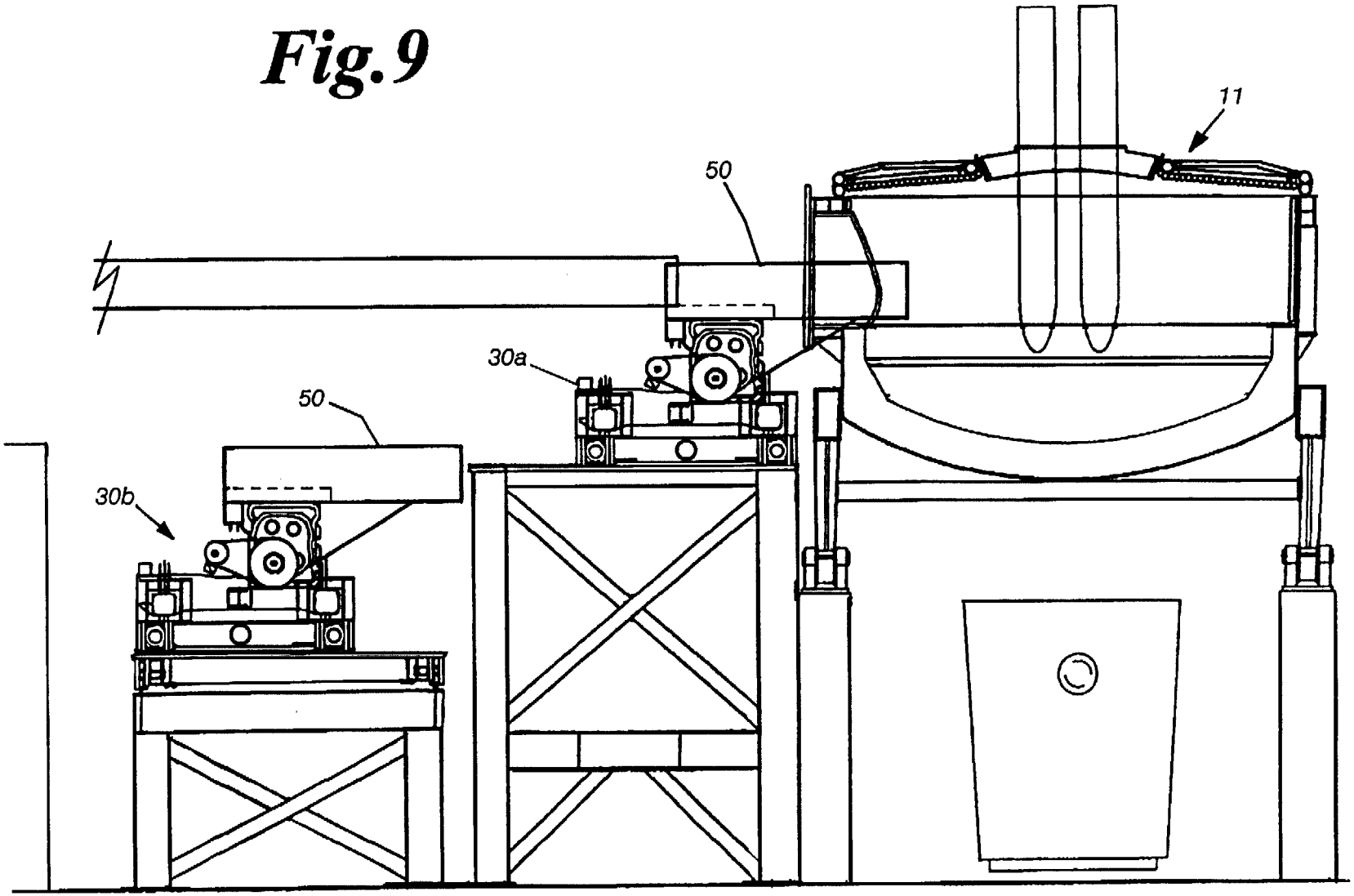
FIG. 9 is a cross-section view of a tiltable three-phase a.c. electric arc furnace with interchangeable connecting cars, and a tapping ladle beneath the furnace.

Referring now to the drawings, which illustrate a preferred embodiment of the invention in a steelmaking process, an electric arc steelmaking furnace 10, FIG. 1, has an associated elongated preheating chamber 12, FIG. 7, including a vibrating channel 14, for heating and introducing charge materials, such as steel or other iron bearing scrap, into the furnace. The furnace 10 can be a three-phase electric arc furnace 11 as shown in FIG. 9, a direct current electric furnace 10 as shown in FIGS. 1, 2, 4, and 5, a plasma furnace or an induction furnace. The preheating chamber 12 has an elongated support covered by a mating elongated hood 16, preferably refractory-lined or partially water cooled, and generally in accordance with my U.S. Pat. No. 4,609,400, details of which are incorporated herein by reference. The heating chamber 12 has a dynamic seal 18 at the charge material entry end. From the charge material entry end, the heating chamber includes sequentially a gas transition section or zone 22, one or more heating sections or zones 24, and a material discharge section 26. Burners 36 provide a portion of the heat in the heating zones. The remainder of the heat is provided by hot furnace off-gases passing through the heating zones to the gas transition zone then to secondary gas treating chamber 42.

A small amount of air enters the gas transition zone 22 through the dynamic seal 18. The amount of air is controlled by adjustment of pressure P1 in the dynamic seal 18, pressure P2 in the gas transition zone 22, and pressure P3 in the secondary gas treating chamber 42. Flow of gas through the secondary gas treating chamber and pressure in the system are controlled by a damper, not shown.

Figure 3:
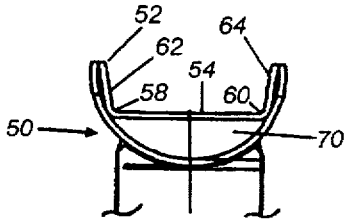
FIG. 3 is a cross-sectional view of the invented connecting car pan of FIG. 1.
Figure 2:
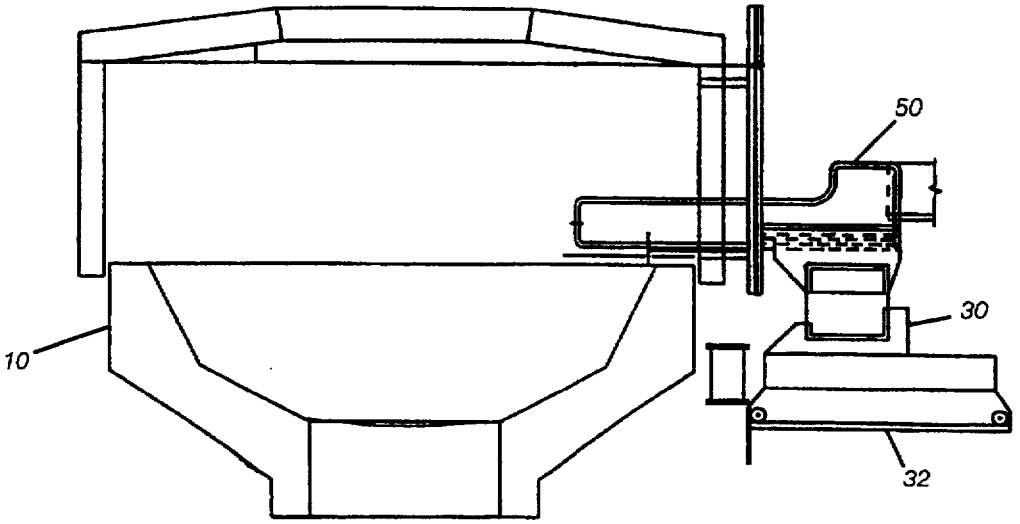
FIG. 2 is a horizontal cross-sectional view taken generally along section line 2—2 of FIG. 1.

Connecting car pan 50, FIG. 3, has an arcuate cross-section, preferably with an arc of at least 150°. A generally flat bottom elongated feed pan 52 has a bottom 54 and a first upstanding sidewall 62 and a second upstanding sidewall 64 extending upwards from the bottom 54 at corners 58 and 60 respectively. The arcuate pan 50 is adapted to receive the generally flat bottom feed pan 52, regardless of its sidewall configuration. If the radius of the arcuate charging pan 50 has a center above the upper extremities of the sidewalls 62, 64 of feed pan 52, the sidewalls 62, 64 can also be provided with an external radius to mate with the internal radius of arcuate pan 50.

The discharge section of the chamber 12 communicates with the connecting car pan 50, which is mounted on connecting car 30 for telescoping axial movement into engagement with the furnace opening 28. This effectively seals the chamber 12 to the furnace 10, which is preferably tiltable up to 15° in either direction (generally about the charging hole) for removing slag and for tapping molten metal product. The connecting car feeds scrap from the preheater to the furnace at the proper location within the furnace. The connecting car 30 is advantageously mounted on a track 32. Connecting car pan support 66 is preferably mounted on a longitudinal vibrating mechanism 68 on the connecting car.

Figure 4:
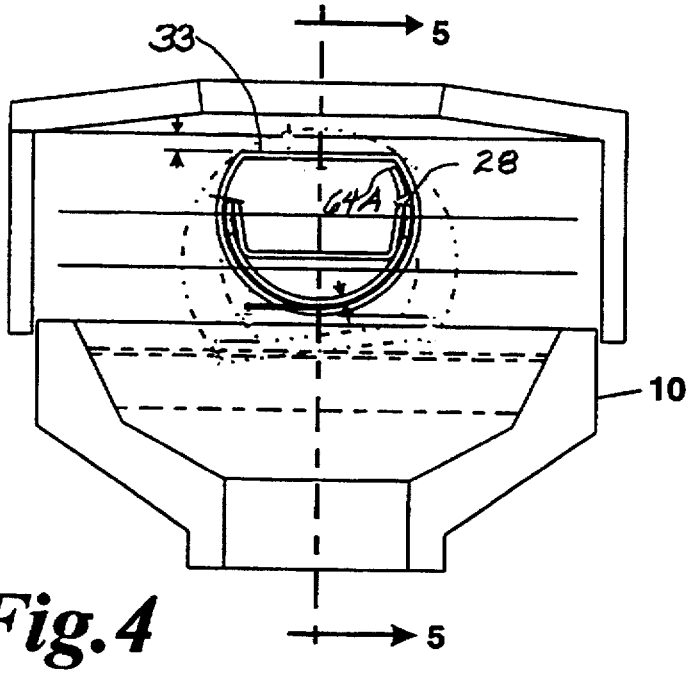
FIG. 4 is a frontal cross-sectional view of an alternative embodiment of the invented connecting car pan of FIG. 1.
Figure 6:
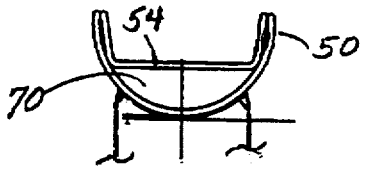
FIG. 6 is a front cross-sectional view of the invented connecting car pan of FIG. 4.

The furnace flange 38 has an opening 28 therein, which has a generally circular shape, or, as shown in FIG. 1, has a flat top 33 on the circular shape. This avoids having corners which collect splash and spatter from the melt and slag within the furnace. Importantly, because of the arcuate (circular) shape of opening 28, it is unnecessary to remove the feed pan 52 from the furnace opening upon tilting the furnace for any reason, or even to withdraw the feed pan slightly. FIG. 4 illustrates the relative location 64A of the upper end of sidewall 64 upon tilting of the furnace.

Figure 5:
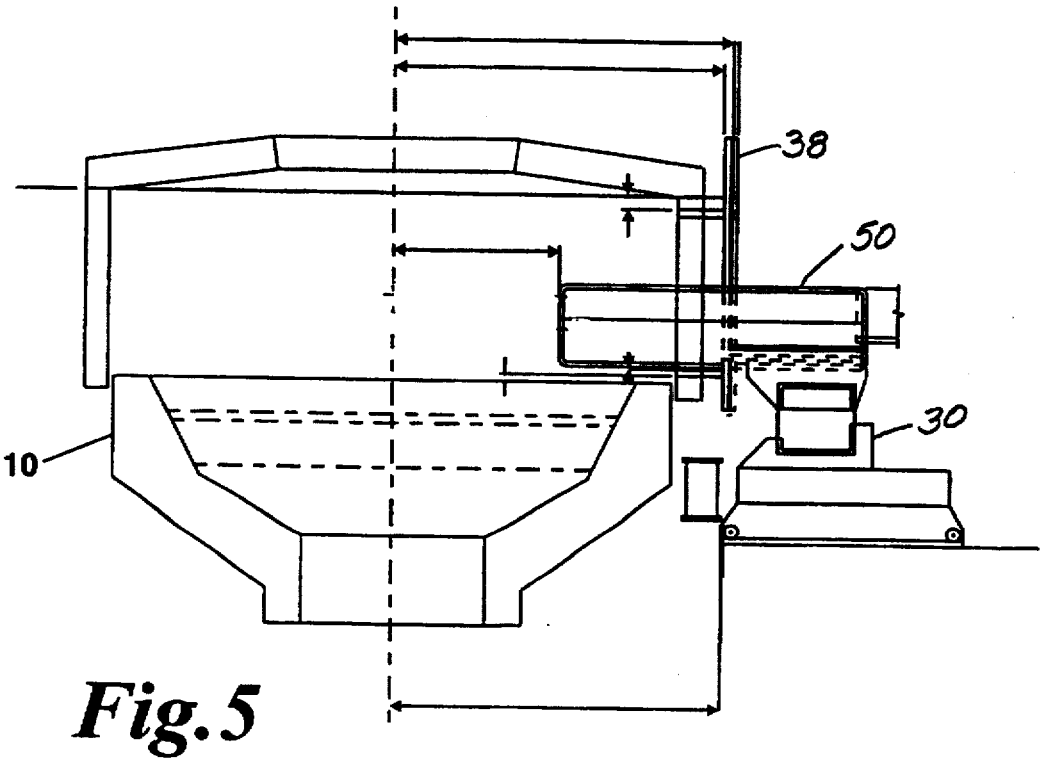
FIG. 5 is a horizontal cross-sectional view taken generally along section line 5—5 of FIG. 4.

The arcuate bottom portion of the connecting car pan 50 beneath the bottom 54 of the pan 52 forms, with the bottom of the pan 52, a secondary feed chamber 70, which extends, as shown in FIGS. 5 and 7, to about the furnace flange 38 from the feed chamber entry end 72. The entry end 72 is normally closed except during feeding of the furnace through chamber 70.

The charging arrangement of the present invention can be provided with two interchangeable connecting cars, each of which is provided with a feed pan 50 in accordance with the invention. This provides a replacement car for maintenance or in case of accident. The region around the furnace charging entryway is an extremely unpleasant place for workers to accomplish any meaningful task, and it is very difficult for a human being to work in this region. The interchangeability of charging cars dramatically shortens the down time or non-productive time of the steel making process. Because all of the product forming materials must move through the charging car on their way into the furnace, an appropriate connecting car is always available.

Figure 8:
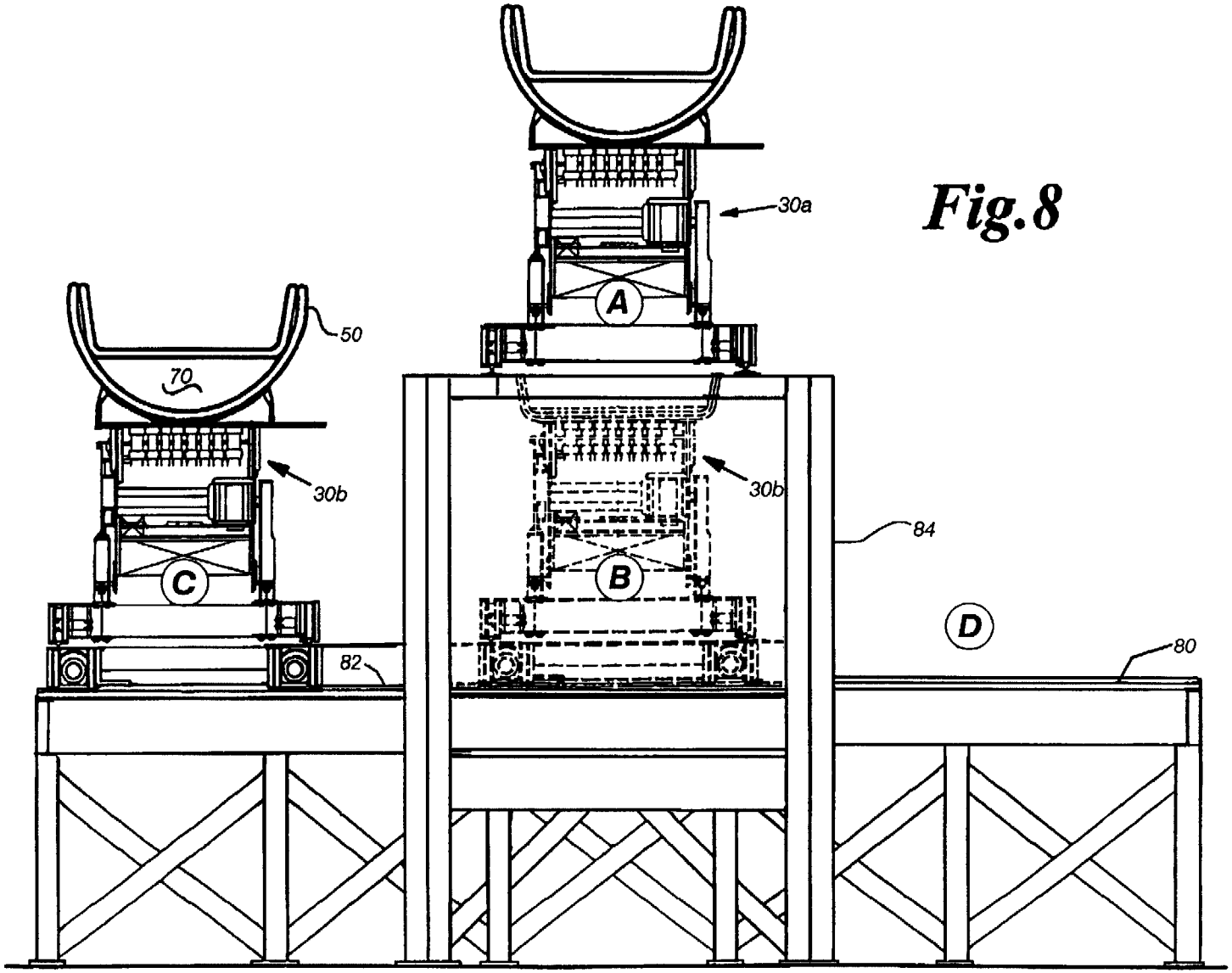
FIG. 8 is a cross-section view of a pair of interchangeable connecting cars and associated transfer mechanism.

As can be readily seen in FIGS. 8 and 9, the charging car is advantageously mounted on a set of wheels which allow movement of the charging car in the longitudinal direction of the charging pan. Beneath the charging car is a truck which is mounted for movement in the direction normal to the direction of movement of the charging car itself. A second charging car is mounted on a similar truck for positioning into alignment with the charging opening in the furnace and the discharge of the preheater.

Referring now to FIG. 8, interchangeable connecting car 30A is shown in the operating position A. Car 30A is downwardly removable to position B on level 80, at which level standby connecting car 30B is in position C. The two cars are then shifted along rails 82 so that the standby car 30B is centered within elevating mechanism 84 and the formerly operating car 30A is moved to the right to a position D. The standby car 30B is then elevated to the operating position A.

As shown in FIG. 9, the standby car 30B may replace the car 30A in the operating position merely by being lifted into position by an overhead traveling crane. Other interchangeable means are within the purview of those skilled in the art.

In another alternative embodiment, the charging car may be moved to one side out of alignment with the furnace charging opening where it can be readily reached by an overhead traveling crane. Any charging car needing maintenance can be removed by crane, and a standby car can be placed into the operating position onto the transfer apparatus then moved into the operating position in alignment with the preheater and the charging opening.

Additional charge material can be fed in any desired manner through the opening 70 such as manually or mechanically, including pneumatic feeding.

SUMMARY OF THE ACHIEVEMENTS OF THE OBJECTS OF THE INVENTION

From the foregoing, it is readily apparent that I have invented an improved method and apparatus for eliminating or greatly reducing the need for ramming out slag from the corners beneath the feed pan in the feed line to a heat processing furnace which uses scrap to make steel. This invention also provides bifurcated feeding which gives more flexibility to the steelmaking process by allowing an improved method of feeding ambient temperature granular materials such as direct reduction iron or slag formers along with preheated scrap iron and steel to the steelmaking furnace. By minimizing the introduction of steel splash or splatter and making interchangeable the connecting car pan, the invention helps reduce maintenance and down time.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

I claim:

1. A feed device for a metal melting furnace, comprising:

an elongated feeder having an arcuate cross-section;

an elongated generally flat bottom feed pan having a first side wall and a second side wall, said feed pan being mounted within said arcuate feeder to divide said arcuate feeder into an upper feed channel and a lower feed channel;

means for introducing heated metal scrap into said upper feed channel; and means for introducing granulated feed material into said lower feed channel.

2. A feed device according to claim 1 wherein said arcuate feeder has an arc of at least 150°.

3. A feed device according to claim 1 wherein said arcuate feeder extends longitudinally beyond said flat bottom feed pan.

4. A feed device according to claim 1 wherein said first and second side walls are arcuate and mate with and within said arcuate feeder.

5. A connecting car for a feeding heat processing furnace, comprising:

a base;

wheels mounted on said base;

a support extending upwardly from said base; and a feeding device mounted on said support, said feeding device comprising:

an elongated feeder having an arcuate cross-section;

an elongated generally flat bottom feed pan having a first side wall and a second side wall, said feed pan being mounted within said arcuate feeder to divide said arcuate feeder into an upper feed channel and a lower feed channel;

means for introducing heated metal scrap into said upper feed channel; and means for introducing granulated feed material into said lower feed channel.

6. A connecting car for a feeding heat processing furnace according to claim 5 wherein said arcuate feeder has an arc of at least 150°.

7. A connecting car for a feeding heat processing furnace according to claim 6 wherein said arcuate feeder extends longitudinally beyond said flat bottom feed pan.

8. A connecting car for a feeding heat processing furnace according to claim 6 further comprising means for moving said connecting car to an elevation out of its operating position.

9. A connecting car for a feeding heat processing furnace according to claim 8 wherein said means for moving said connecting car to an elevation out of its operating position comprises a platform engageable by said wheels mounted on said base, elevator means adapted to receive and move said platform vertically, and lateral transfer means positioned at an elevation lower than the connecting car operating position for replacing the connecting car with a second connecting car from a stand-by position at said lower elevation.

10. A method of feeding an electric arc steelmaking furnace, comprising the steps of:

inserting a bifurcated feeder partially through a sidewall of the furnace;

introducing heated steel scrap through one channel of the bifurcated feeder; and introducing through a second channel of the bifurcated feeder feed materials selected from the group consisting of slag formers, slag foamers, alloy agents, carburizers, and direct reduced iron.

11. A method according to claim 10, further comprising tilting the furnace up to 15° for slagging or tapping without withdrawing the bifurcated feeder.

12. A method of feeding an electric arc steelmaking furnace in accordance with claim 8, further comprising maintaining full electric power to the steelmaking furnace at all times, including during feeding and tapping.

* * * * *